US008159415B2

(12) United States Patent
Choi et al.

(10) Patent No.: US 8,159,415 B2
(45) Date of Patent: Apr. 17, 2012

(54) DISPLAY DEVICE AND DRIVING METHOD THEREOF

(75) Inventors: Chang-ik Choi, Suwon-si (KR); Young-chan Kim, Uiwang-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 719 days.

(21) Appl. No.: 11/603,217

(22) Filed: Nov. 22, 2006

(65) Prior Publication Data

US 2007/0210984 A1 Sep. 13, 2007

(30) Foreign Application Priority Data

Mar. 9, 2006 (KR) ..... 10-2006-0022043

(51) Int. Cl.
*G09G 5/00* (2006.01)

(52) U.S. Cl. ..... 345/3.4

(58) Field of Classification Search ..... 345/204, 345/581, 699, 211, 213, 3.1, 3.4
See application file for complete search history.

(56) References Cited

U.S. PATENT DOCUMENTS

| | | | | |
|---|---|---|---|---|
| 6,329,983 | B1 * | 12/2001 | Wang | 345/211 |
| 6,368,155 | B1 * | 4/2002 | Bassler et al. | 439/620.21 |
| 6,618,773 | B1 | 9/2003 | Chang et al. | |
| 6,804,724 | B2 * | 10/2004 | Shin | 710/2 |
| 7,414,619 | B2 * | 8/2008 | Kim | 345/204 |
| 2001/0004257 | A1 * | 6/2001 | Nitta et al. | 345/211 |
| 2004/0027357 | A1 * | 2/2004 | Mendelson et al. | 345/581 |
| 2004/0027515 | A1 * | 2/2004 | Itakura | 349/110 |
| 2004/0119731 | A1 | 6/2004 | Lee | |
| 2005/0062735 | A1 * | 3/2005 | Kim | 345/204 |
| 2006/0114248 | A1 * | 6/2006 | Lee et al. | 345/204 |
| 2008/0136803 | A1 * | 6/2008 | Slaton | 345/211 |

FOREIGN PATENT DOCUMENTS

| | | |
|---|---|---|
| KR | 2003-7183 | 1/2003 |
| KR | 2005-35512 | 4/2005 |
| KR | 2005-78113 | 8/2005 |

OTHER PUBLICATIONS

European Search Report dated May 7, 2009 issued in EP 06077095.5.

* cited by examiner

*Primary Examiner* — Quan-Zhen Wang
*Assistant Examiner* — Tony Davis
(74) *Attorney, Agent, or Firm* — Stanzione & Kim, LLP

(57) ABSTRACT

Provided are a display device and a driving method thereof, which is miniaturized thereby reducing manufacturing costs. The display device includes an interface which receives image information from at least one host device according to a specified or an unspecified transmission scheme to communicate with the host device, a memory which stores first recognition information corresponding to the specified transmission scheme and if the image information is applied according to the specified transmission scheme, which outputs the first recognition information through the interface to the host device, and a control unit which stores second recognition information corresponding to the unspecified transmission scheme and if the image information is applied according to the unspecified transmission scheme, which reads the second recognition information and outputs the read information through the interface to the host device.

22 Claims, 7 Drawing Sheets

FIG. 2

| | STATUS CHECK PIN POTENTIAL LEVEL | SWITCH | MEMORY | CONTROLLER | STORAGE UNIT |
|---|---|---|---|---|---|
| DIGITAL TRANSMISSION SCHEME | LOW | ON | ON | SET IMAGE QUALITY MODE WITH IMAGE INFORMATION RECEIVED ACCORDING TO DIGITAL TRANSMISSION SCHEME | STORE ONLY IMAGE QUALITY MODE SET BY CONTROLLER |
| ANALOG TRANSMISSION SCHEME | HIGH | OFF | OFF | SET IMAGE QUALITY MODE WITH IMAGE INFORMATION RECEIVED ACCORDING TO ANALOG TRANSMISSION SCHEME AND READ SECOND RECOGNITION INFORMATION FROM STORAGE UNIT | STORE RECOGNITION INFORMATION CORRESPONDING TO ANALOG TRANSMISSION SCHEME AND IMAGE QUALITY MODE SET BY CONTROLLER |

FIG. 5

| DDC Port | | | | | | | | | | | |
|---|---|---|---|---|---|---|---|---|---|---|---|
| Address | Register | Reset | R/W | Bit 7 | Bit 6 | Bit 5 | Bit 4 | Bit 3 | Bit 2 | Bit 1 | Bit 0 |
| $F01C | DDC_CTRL | 4BH | W | EN_DDC | WPT_DDC | LEN_EDID | MODE_DDC | EN_BACK | INVT_VCLK | CLR_PTR | CLR_UPD |
| $F01D | DDC_REG | 00H | W | WR_SUCC | | - | - | - | - | - | - |
| | | 00H | R | WR_SUCC | - | - | - | - | OVF_DDC | IS_CLRD | UPD_DDC |
| $F01E | DDC_ADDR | 00H | W | VALID_B3 | VALID_B2 | VALID_B2 | - | ADDR_B3 | ADDR_B2 | ADDR_B1 | - |
| Single Master 12C-bus Port 0(on DDC Port) | | | | | | | | | | | |
| Address | Register | Reset | R/W | Bit 7 | Bit 6 | Bit 5 | Bit 4 | Bit 3 | Bit 2 | Bit 1 | Bit 0 |
| $F01F | INTIICO_FLG | 00H | R | - | - | - | INTA0 | INTTX0 | INTRX0 | INTNAK0 | INTSTOP0 |
| | INTIICO_CLR | 00H | W | - | - | - | INTA0 | INTTX0 | INTRX0 | INTNAK0 | INTSTOP0 |
| $F020 | INTIICO_EN | 00H | W | - | - | - | INTA0 | INTTX0 | INTRX0 | INTNAK0 | INTSTOP0 |
| $F021 | IICO_ADDR | xxH | W | ADR_B7-ADR_B1 | | | | | | | EN_IICO |

FIG. 6

```
If(ValBit(P0,CABLE_ID))
{
//DVI-I to DVI-D cable CONNECTION
      DDC_CTRL=0x00; //DDC FUNCTION Disable
}
Else
{
//DVI-I to DSUB cable CONNECTION
      DDC_CTRL=0x80; //DDC FUNCTION Enable
}
```

DISPLAY DEVICE AND DRIVING METHOD THEREOF

CROSS-REFERENCE TO RELATED APPLICATIONS

This application claims priority under 35 U.S.C. 119§(a) from Korean Patent Application No. 10-2006-0022043 filed on Mar. 9, 2006 in the Korean Intellectual Property Office, the disclosure of which is incorporated herein in its entirety by reference.

BACKGROUND OF THE INVENTION

1. Field of the Invention

The present general inventive concept relates to a display device and a driving method thereof. More particularly, the present general inventive concept relates to a display device that can be miniaturized and can reduce manufacturing costs, and a driving method thereof.

2. Description of the Related Art

A digital visual interface (DVI), which is a standard to transmit digital data generated in a personal computer (PC) to a monitor, has been mainly employed with a device that is connected to a PC, such as a projector for business, a commercial plasma display, and an electric board. Recently, the DVI has been introduced to an electronic appliance including a digital TV, a set-top box, etc.

Such a DVI standard has been developed in order to directly transmit digital data without complicated processes. Generally, digital data is transmitted according to complicated processes as follows: a PC generates digital data and converts the digital data into analog data to transmit to a display device, and then the display device converts again the received analog data into digital data.

In accordance with requests of content providers providing this digital data, service providers and electronic appliance providers employ DVI instead of various interfaces such as an IEEE 1394 and an analog connector.

To employ the DVI, a display data channel (DDC) is indispensable. The DDC is a standard that changes recognition information of a display device between a host device outputting image information such as a personal computer (PC) and a display device, and sets a display setting of the display device. The recognition information, for example, may indicate an attribute of the display device such as an optimal resolution.

The display device employing the DVI standard includes a DVI connector having a DDC channel, such as SDA and SCL, to transmit and receive the recognition information, such as extended display identification data (EDID).

Generally, the display device employing the DVI standard needs various functions besides its basic function in which the display device is connected to a PC to receive the processed image signal from the PC and display an image. The various functions include, for example, a function of displaying an image using an image signal output from an image reproducing device such as a DVD player.

Additionally, the display device needs functions of displaying an image using digital image information that is output from a host system, which provides image information, such as the PC and the DVD, and also using analog image information that is output from a PC.

Accordingly, when the digital image information and the analog image information are transmitted and received through the DVI connector, the appropriate recognition information corresponding to the signal transmission scheme should be output to the host device, since the recognition information of the display device corresponding to the digital signal transmission scheme and that corresponding to the analog signal transmission scheme are different from each other.

FIG. 7 is a schematic block diagram of a display device 10 according to a comparative example, and FIG. 8 is a view of an example of a switch 12 illustrated in FIG. 7.

Referring to FIG. 7, the display device 10 includes a DVI connector 11, a switch 12, a first memory 13, a second memory 14, a control unit 15 including a controller 15-1 and a storage unit 15-2, and a display 16.

In detail, the DVI connector 11 transmits and receives digital image information D_ID and the analog image information A_ID to and from external host devices 20 and 30, respectively. At this time, the display device 10 may transmit and receive the digital and analog image information to and from one host device such as a PC.

The switch 12 selectively provides the driving voltage VDD to the first memory 13 and the second memory 14 depending on a transmission scheme of the image information. The operations of the switch 12 are as follows.

When the display device 10 is connected to the first host device 20, a first transmission cable (hereinafter referred to as "cable 1") may be connected to the DVI connector 11, which has a 24 pin DVI-D terminal transmitting and receiving the digital image information. Additionally, in order to connect the display device 10 to the second host device 30, a second transmission cable (hereinafter referred to as "cable 2") may be connected to the DVI connector 11, which has a 15 pin D-SUB terminal transmitting and receiving the analog image information.

The connected terminals of the transmission cable 1 and the transmission cable 2 are different from each other. Accordingly, when transmission cable 2 is connected, some signal pins of the DVI connector 11 are not connected to transmission cable 2, and a certain pin among these signal pins is pre-set as a status check pin.

At this time, high voltage potential levels are basically applied to the signal pins of the DVI connector 11, and also to the status check pin. The potential levels of the status check pin are different between when the transmission cable 1 is connected and when transmission cable 2 is connected.

The switch 12 receives the potential levels of the status check pin, which are differently formed when transmission cable 1 is connected and when transmission cable 2 is connected, as a control signal CNT to perform switching.

For example, as illustrated in FIG. 8, when the status check pin of the DVI connector 11 is connected through transmission cable 1 to the switch 12, the status check pin is connected to a ground terminal GND of the first host device 20 and its status is changed to a low potential level. This low potential level is applied as a control signal CNT of the switch 12, and accordingly, a first switch element 12-1 is activated so that the driving voltage VDD is applied to the first memory 13 and the first memory 13 is activated.

In contrast, if the status check pin of the DVI connector 11 is connected through transmission cable 2, the status check pin is formed in a floating status and its high potential level is maintained. The high potential level is applied as a control signal CNT of the switch 12, and accordingly, a second switch element 12-2 is activated so that the driving voltage VDD is applied to the second memory 14 and the second memory 14 is activated.

The first memory 13 stores the recognition information corresponding to the digital image information, for example, digital EDID information, and the second memory 14 stores the recognition information corresponding to the analog image information, for example, analog EDID information.

Accordingly, one of the first memory 13 and the second memory 14 is selectively activated by the driving voltage VDD that is selectively provided by the switch 12. The digital and analog EDID information stored in each of the first memory 13 and the second memory 14 is read to the DVI connector 11 depending on the control signals output from the controller 15-1 and transmitted to the host devices 20 and 30.

By the above process, the host devices 20 and 30 determine the attribute of the display device 10 based on recognition information REC_D1 and REC_D2 output from the display device 10, and transmit control signals to the display device 10 to set an image quality mode Q_mode of the display 16, in response to the recognition information REC_D1 and REC_D2. The image quality mode Q_mode set by the display device 10 is stored into the storage 15-2.

The host devices 20 and 30 transmit the digital or analog image information D_ID or A_ID to the display device 10 according to the digital or analog transmission scheme, and display a certain image on the display 16 in response to the stored image quality mode Q_mode and the digital or analog image information D_ID or A_ID.

Generally, the first memory 13 and the second memory 14 are configured as a non-volatile memory such as an EEPROM to store the recognition information even when power is not supplied to the display device 10.

In the case of an analog transmission scheme, the recognition information is read from the second memory 14 so that the image information can be output from the second host device 30, according to the characteristics of the analog transmission scheme, even when power is not supplied to the display device 10. However, in the case of a digital transmission scheme, the recognition information cannot be read from the first memory 13 when power is not supplied to the display device 10. In this case, the image information itself may be blocked from being output from the first host device 20 so that separate memories 13 and 14 are provided as illustrated in FIG. 8 to prevent this problem.

However, if each memory is provided to store the recognition information which corresponds to each transmission scheme depending on the transmission scheme of the image information, it is difficult to miniaturize the display device and reduce its manufacturing costs.

SUMMARY OF THE INVENTION

The present general inventive concept provides a display device that can reduce the amount of memory used so that the size of the display device can be miniaturized, resulting in reduced manufacturing costs.

The present general inventive concept also provides a driving method of the display device.

Additional aspects and utilities of the present general inventive concept will be set forth in part in the description which follows and, in part, will be obvious from the description, or may be learned by practice of the general inventive concept The foregoing and/or other aspects and utilities of the present general inventive concept may be achieved by providing a display device including an interface which receives image information from at least one host device according to a specified or an unspecified transmission scheme to communicate with the host device, a memory which stores a first recognition information corresponding to the specified transmission scheme and outputs the first recognition information through the interface to the host device if the image information is applied according to the specified transmission scheme, and a control unit which reads and stores a second recognition information corresponding to the unspecified transmission scheme, and outputs the second recognition information through the interface to the host device if the image information is applied according to the unspecified transmission scheme.

The interface may include a digital visual interface-integrated (DVI-I) connector.

The interface may include a plurality of signal pins, and at least one of the signal pins is set as a status check pin to determine the transmission schemes. The status check pin may be in each different potential level depending on the transmission schemes.

The display device may further include a switch which is selectively activated depending on a potential level of the status check pin to provide a driving voltage to the memory. The control unit may be connected to the status check pin to provide the second recognition information to the interface depending on the potential level of the status check pin.

The control unit may further include a storage unit which stores the second recognition information.

The storage unit may store an image quality mode set in response to the image information, and the second recognition information may be stored to the storage unit according to an address allocation scheme.

The control unit may read the second recognition information from the storage unit in response to the image information applied according to the unspecified transmission scheme.

The first recognition information may include digital extended display identification data (EDID) and the second recognition information may comprise analog EDID.

The foregoing and/or other aspects and utilities of the present general inventive concept may also be achieved by providing a method of driving a display device which receives image information from at least one host device and communicates with the host device to display an image, the method including operations of receiving the image information, determining a transmission scheme of the image information, reading first recognition information from a memory which stores the first recognition information corresponding to the specified transmission scheme when the determined transmission scheme is a specified transmission scheme, providing the read first recognition information to the host device, and reading second recognition information from a control unit which controls a driving of the display device and stores the second recognition information corresponding to the unspecified transmission scheme device when the determined transmission scheme is an unspecified transmission scheme, and providing the read second recognition information to the host.

The image information may be received through a digital visual interface-integrated (DVI-I) connector.

The method may further include an operation of, if the image information is transmitted according to the specified transmission scheme, providing a driving voltage to the memory to activate the memory, and if the image information is transmitted according to the unspecified transmission scheme, preventing the driving voltage from being provided to the memory to deactivate the memory.

Determining the transmission scheme of the image information may determine a change of a potential level of a signal pin that is set as a status check pin among a plurality of signal pins included in the DVI-I connector.

If the status check pin is not connected to the host device, the status check pin may be in a high potential level, and if the status check pin is connected to the host device, the status check pin may be in a low potential level.

Reading the first recognition information may activate the memory to read the first recognition information, and prevent the second recognition information from being read from the control unit.

Reading the second recognition information may deactivate the memory to prevent the first recognition information from being read, thereby reading the second recognition information that is stored in the control unit according to an address allocation scheme.

The first recognition information may include digital extended display identification data (EDID) and the second recognition information may comprise analog EDID.

The method may also include an operation of, in response to recognition information, setting an image quality mode by image information provided from the host device according to each transmission scheme, and displaying the image information as a specified image with the set image quality mode.

Displaying the image information as the specified image may store the set image quality mode into the control unit, and displays the image information as the specified image depending on the image quality mode stored in the control unit.

The foregoing and/or other aspects and utilities of the present general inventive concept may be achieved by providing a display device including an interface to receive different types of image information from corresponding different hosts, each having different transmission schemes in which to communicate with the respective host, a memory to store recognition information corresponding to a specified transmission scheme, and to output the recognition information corresponding to the specified transmission scheme through the interface to the corresponding host if the image information received by the interface corresponds to the specified transmission scheme and a control unit to store recognition information corresponding to an unspecified transmission scheme, and to output the recognition information corresponding to an unspecified transmission scheme through the interface to the corresponding host if the image information received by the interface corresponds to the unspecified transmission scheme.

BRIEF DESCRIPTION OF THE DRAWINGS

The above aspects and features of the present general inventive concept will be more apparent by describing certain embodiments of the present general inventive concept with reference to the accompanying drawings, in which:

FIG. 2 is a view explaining operations of each member depending on a transmission scheme of image information applied to the display device illustrated in FIG. 1 according to an exemplary embodiment of the present general inventive concept;

FIG. 5 illustrates registers of a control unit explaining a driving method of a display device illustrated in FIG. 4 according to an exemplary embodiment of the present general inventive concept;

FIG. 6 illustrates a part of source codes explaining a driving method of a display device illustrated in FIG. 4 according to an exemplary embodiment of the present general inventive concept;

DETAILED DESCRIPTION OF THE PREFERRED EMBODIMENTS

Figure 1:
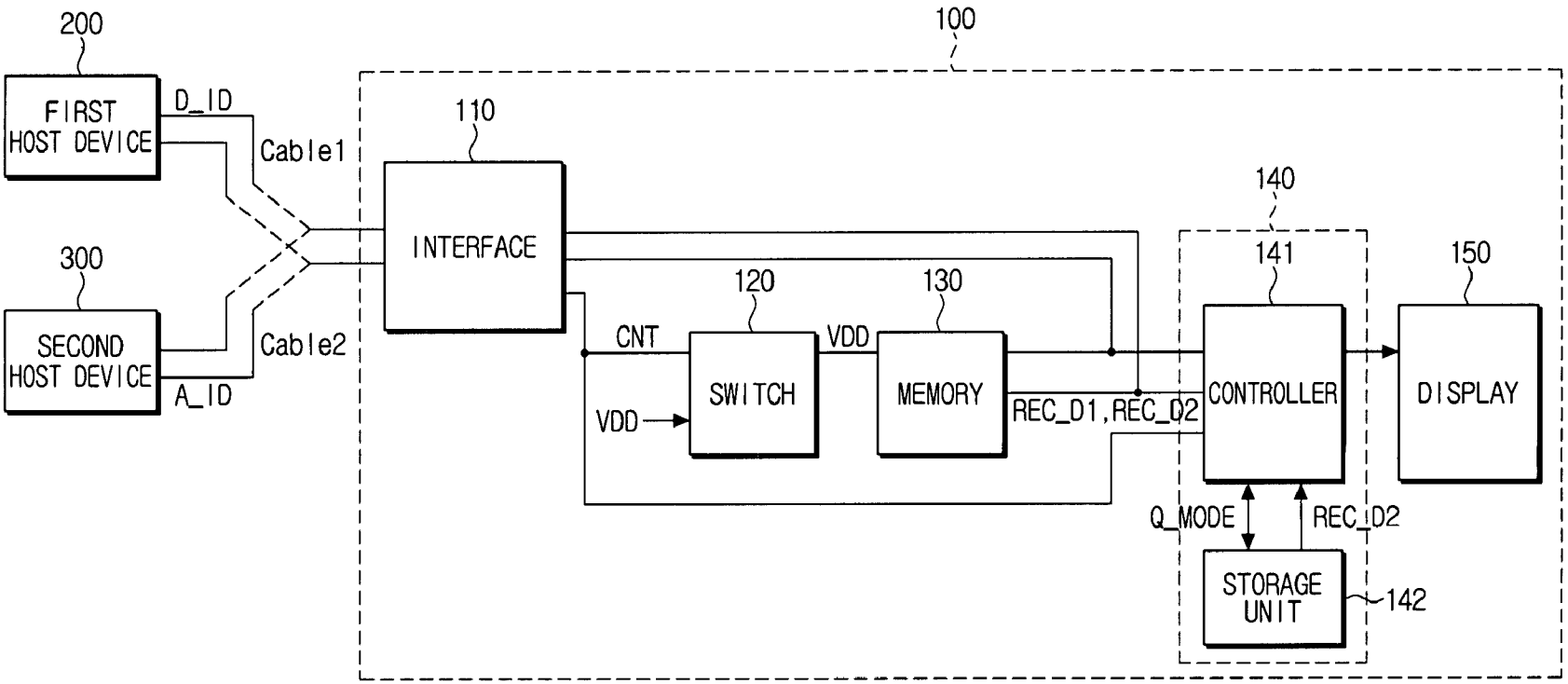
FIG. 1 is a schematic block diagram of a display device according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
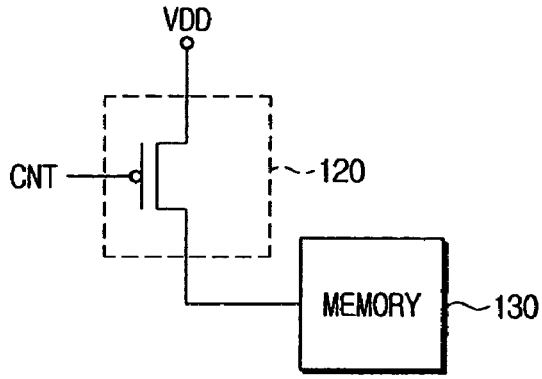
FIG. 3 is a view of a switch illustrated in FIG. 1 according to an exemplary embodiment of the present general inventive concept.

FIG. 1 is a schematic block diagram of a display device 100 according to an exemplary embodiment of the present general inventive concept, FIG. 2 is a view explaining operations of each member depending on a transmission scheme of image information applied to the display device 100 illustrated in FIG. 1 according to an exemplary embodiment of the present general inventive concept, and FIG. 3 is a view of a switch 120 illustrated in FIG. 1 according to an exemplary embodiment of the present general inventive concept.

Referring to FIG. 1, the display device 100 according to an exemplary embodiment of the present general inventive concept includes an interface 110, a switch 120, a memory 130, a control unit 140, and a display 150.

In detail, the interface 110 receives image information from external host devices 200 and 300, and the display device 100 communicates through the interface 110 with the host devices 200 and 300. The interface 110 may receive a digital image signal D_ID from a first host device 200 according to a digital transmission scheme, an analog image signal A_ID from a second host device 300 according to an analog transmission scheme, and digital and analog image information from one host device such as a PC.

The interface 110 may include a DVI connector having a plurality of signal pins. The DVI connector includes DDC channels SDA and SCL to employ the DDC. The image information includes DDC_DATA, DDC_CLK signal, and EDID signal to perform an interface between the host devices 200 and 300 and the display device 100 through the DDC channels SDA and SCL, and an image data signal received through the DVI connector to display a certain image.

The switch 120 is selectively activated by the signal transmission scheme of the image information applied to the interface 110 to provide the driving voltage VDD, received from the outside, to the memory 130.

When the image information, input to the interface 110, is applied according to a digital transmission scheme and an analog transmission scheme depending on whether the image information is a digital image signal provided from the first host device 200 or an analog image signal provided from the second host device 300, the switch 120 specifies one of the digital transmission scheme and the analog transmission scheme to provide the driving voltage VDD to the memory 130.

In the present exemplary embodiment, for example, the digital transmission scheme is used as a specified transmission scheme, and the switch 120 is activated when the image information is input according to the digital transmission scheme. To activate the switch 120 when the image information is input according to the digital transmission scheme, the following method is used.

Referring to FIGS. 1 and 2, transmission cables are connected to the interface 110 to perform an interface with the host devices 200 and 300. In a case of the digital transmission scheme, for example, a first transmission cable (hereinafter referred to as "transmission cable 1") with a 24 pin DVI-D terminal may be connected to the interface 110 to transmit and receive the digital image information. In a case of the analog transmission scheme, for example, a second transmission cable (hereinafter referred to as "transmission cable 2") with 15 pin D-SUB terminal may be connected to the interface 110 to transmit and receive the analog image information.

Accordingly, the signal pins of the interface 100 connector (i.e. DVI connector) connected to each cable are differentiated between when the transmission cable 1 is connected to the interface 110 and when the transmission cable 2 is connected to the interface 110. When the transmission cable 2 is connected, one of the signal pins which is not connected to the second host device 300, is pre-set as a status check pin.

The pre-set status check pin has each different potential level when the transmission cable 1 is connected and when the transmission cable 2 is connected.

In detail, a high voltage potential level can basically be applied to the interface 110 so that the status check pin has a high potential level, and if the transmission cable 1 is connected, the status check pin can be connected to the ground terminal GND of the first host device 200 so as to have a low potential level LOW. If the transmission cable 2 is connected to the interface 110, the status check pin can float with the second host device 300 so as to maintain a high potential level HIGH.

As illustrated in FIG. 3, the switch 120 receives the potential level of the status check pin as a control signal CNT to perform a switching operation. In detail, the switch 120 is activated by the control signal CNT at the low potential level LOW so as to provide the driving voltage VDD, applied from the exterior, to the memory 130 only when the status check pin of the interface 110 is connected to the transmission cable 1.

The memory 130 is activated by the driving voltage VDD that is selectively provided from the switch 120 when the image information is applied from the first host device 200 according to a digital transmission scheme. A recognition information REC_D1 (hereafter, referred to as the first recognition information), which corresponds to the specified transmission scheme and is stored in the memory 130, for example, the digital EDID corresponding to the digital transmission scheme, is read in response to a command to read the image information, which is applied from the first host device 200, for example, first recognition information REC_D1 contained in the image information, The read first recognition information REC_D1 is provided to the interface 110 and transmitted to the first host device 200.

The memory 130 may be a non-volatile memory EEPROM to store the first recognition information REC_D1 even when power is not supplied to the display device 100.

The control unit 140 controls the display device 100, and more particularly, sets an image quality mode Q_mode of the display 150, controls general operations of the display 150, and stores the set image quality mode Q_mode. To this end, the control unit 140 includes a controller 141 to set an image quality mode of the display 150 and control operations of the display 150, and a storage unit 142 to store the set image quality mode Q_mode.

If the image information is received according to an unspecified transmission scheme such as an analog transmission scheme from the second host device 300, the control unit 140 reads second recognition information REC_D2 from the storage unit 142, which has the second recognition information REC_D2 stored therein corresponding to the analog transmission scheme, to provide to the interface 110. The operation of the control unit 140 will be explained in detail below.

Referring to FIGS. 1 and 2, if the image information is received according to the digital transmission scheme from the first host device 200, the controller 141 sets an image quality mode MODE_D of the display 150 in response to the image information received according to the digital transmission scheme, and stores the set image quality mode MODE_D into the storage unit 142. The controller 141 also controls the display 150 to display an image with a certain image quality mode in response to the set image quality mode MODE_D and the image information received according to the digital transmission scheme.

At this time, the controller 141 is connected to the status check pin of the interface 110, and receives the changing potential level of the status check pin as a control signal to determine the transmission scheme of the image information input to the interface 110. In other words, for example, if the status check pin of the interface 110 is in a low potential level, the controller 141 determines that the transmission scheme of the image information is a digital transmission scheme, and ignores the command to read the recognition information REC included in the header of the image information received from the first host device 200. Accordingly, if the image information is transmitted according to a digital transmission scheme, the controller 141 prevents the second recognition information REC_D2, stored in the storage unit 142, from being read.

Then, if the image information is received from the second host device 300 according to an analog transmission information, in response to the image information received according to the analog transmission scheme, the controller 141 reads the second recognition information REC_D2, pre-stored in the storage unit 142, and provides the second recognition information REC_D2 to the interface 110.

In the storage unit 142, according to an address allocation scheme, a certain address is configured as an address that stores data such as VCP_CODE according to a video electronics standards association (VESA) that sets an image quality mode, and another address other than the certain address is configured as an address that stores the second recognition information REC_D2. To this end, the storage unit 142 may be a non-volatile memory EEPROM so as to store the data regarding the image quality mode and the second recognition information REC_D2 even if power is not supplied to the display device 100.

In response to the image information received from the second host device 300 according to the analog transmission scheme, the controller 141 reads the second recognition information REC_D2 that is stored as 2Bi in the storage unit 142 according to the VESA.

The controller 141 reads the second recognition information REC_D2 to convert it into 2B according to VESA, and provides the converted second recognition information REC_D2 to the interface 110 so as to be interfaced with the host devices 200 and 300.

The controller 141 sets an image quality mode MODE_D of the display 150 based on the image information received according to the analog transmission scheme. The set image quality mode MODE_D is stored at a certain address of the storage unit 142.

The controller 141 is connected to the status check pin of the interface 110 and receives the potential level of the status check pin as a control signal so as to determine a transmission scheme of the image information input to the interface 110. In detail, if the status check pin of the interface 110 is in a high potential level, the controller 141 determines the transmission scheme of the image information is an analog one, and performs the command to read the recognition information REC included in the header of the image information received from the second host device 300. Accordingly, if the image information is transmitted according to an analog transmission scheme, the controller 141 reads the second recognition information REC_D2 stored in the storage unit 142. At this time, the switch 120 is deactivated by the high potential level of the status check pin, and the first recognition information REC_D1 is prevented from being read.

In other words, if the image information is received according to the digital transmission scheme in response to the control signal CNT of the low potential level, the controller 141 prevents the second recognition information REC_D2 from being read from the storage unit 142. If the image information is received according to the analog transmission scheme, the controller 141 reads the second recognition information REC_D2. The control unit 140 may be a micro controller unit (MCU) or a scaler.

In the present exemplary embodiment, the controller 141 and the storage unit 142 are illustrated as being provided in one control unit 140. However, this should not be considered as limiting. The controller 141 and the storage unit 142 may be configured as individual elements.

Additionally, the switch 120 may be selectively activated under the control of the control unit 140.

The display 150 displays a certain image in response to the image quality mode Q_mode set by the control unit 140 and the received image information, particularly the image data signal.

Figure 4:
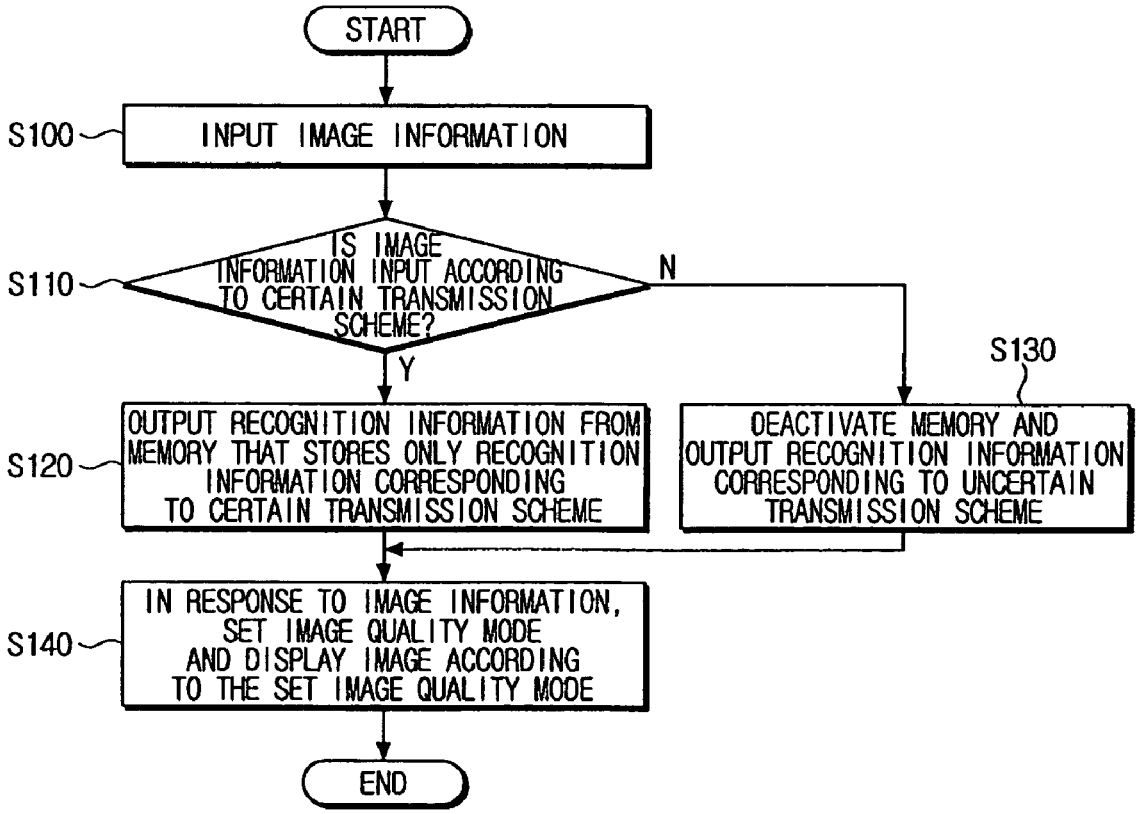
FIG. 4 is a flowchart of a driving method of a display device according to an exemplary embodiment of the present general inventive concept.
Figure 7:
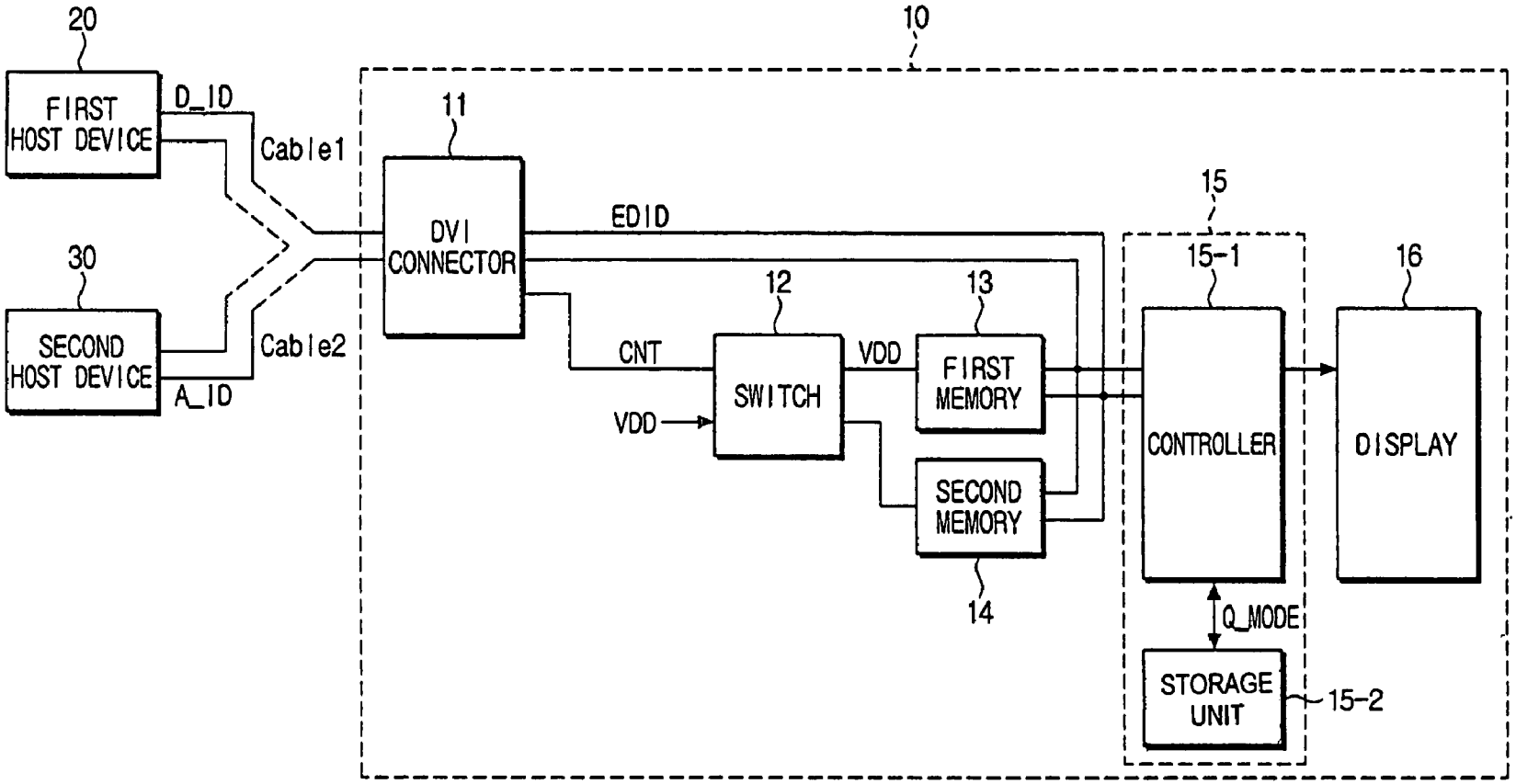
FIG. 7 (PRIOR ART)
FIG. 7 is a schematic block diagram of a display device according to a related art of the present general inventive concept.
Figure 8:
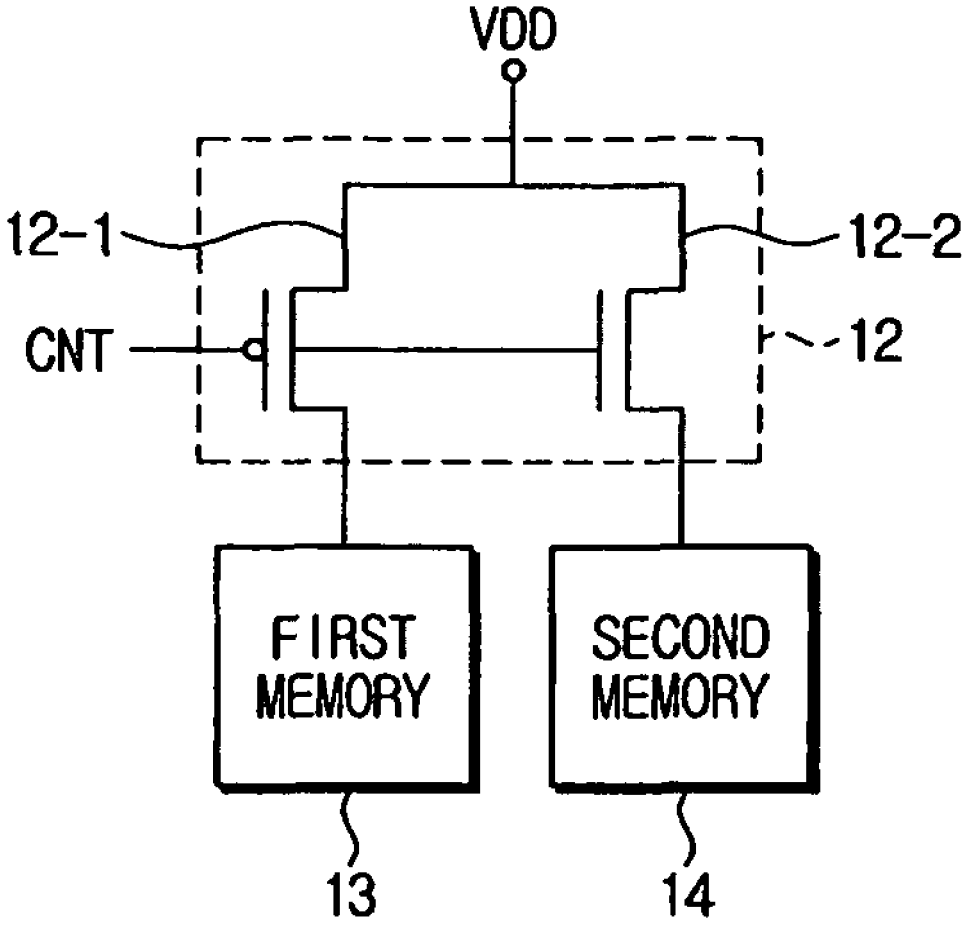
FIG. 8 (PRIOR ART)
FIG. 8 illustrates an example of a switch illustrated in FIG. 7.

FIG. 4 is a flowchart of a driving method of a display device according to an exemplary embodiment of the present general inventive concept.

Referring to FIGS. 1 and 4, the driving method of the display device according to an exemplary embodiment of the present general inventive concept includes inputting image information (operation S100), determining a transmission scheme of the image information (operation S110), if the determined transmission scheme is a specified transmission scheme, reading the first recognition information from the memory, which stores the first recognition information corresponding to the specified transmission scheme, to provide to the host device (operation S120), if the determined transmission scheme is an unspecified transmission scheme, reading the second recognition information, which corresponds to the unspecified transmission scheme and is stored into the control unit that controls the driving of the display device, to provide to the host device (operation S130), and setting an image quality mode by the image information provided according to each transmission scheme from the host device in response to the recognition information and displaying the image information as a certain image with the set image quality (operation S140).

In operation S100, the image information is input through the interface 110 to the display device 100 from the first host device 200, the second host device 300, or one host device according to each different transmission scheme such as a digital transmission scheme or an analog transmission scheme.

In operation S110, the display device 100 determines that the image information is received according to a specified transmission scheme, that is, a digital transmission scheme, from the first host device 200 when the pre-set status check pin of the interface 110 is in a low potential level, that is, in a ground voltage as explained with reference to FIG. 1. In contrast, if the status check pin is in a high potential level, the display device 100 determines that the image information is received according to an unspecified transmission scheme, that is, an analog transmission scheme, from the second host device 300, or one host device according to each of the digital transmission scheme and analog transmission scheme.

In operation S120, if the image information is received from the first host device 200 according to the digital transmission scheme, the switch 120 is activated by the potential level of the status check pin that is configured in a low potential level, and transmits the driving voltage VDD to the memory 130 to activate the memory 130.

At this time, only the first recognition information REC_D1 is stored in the memory 130, and the first recognition information REC_D1 is read from the memory 130 as a result of a command to read the image information, i.e. the recognition information REC, received from the first host device 200. At this time, as the status check pin is in a low potential level, the control unit 140 ignores the command to read the recognition information REC so as to prevent the second recognition information REC_D2 stored in the storage unit 142 from being read. The read first recognition information REC_D1 is transmitted via the interface 110 to the first host device 200.

In operation S130, if the image information is received from the second host device 300 according to the analog transmission scheme, the switch 120 is deactivated by the potential level of the status check pin that maintains a high potential level, and the driving voltage VDD cannot be transmitted to the memory 130 so that the memory 130 is deactivated.

The image information transmitted to the interface 110 is applied to the control unit 140, which performs the command to read the recognition information as the status check pin of the interface 110 is in a high potential level. In other words, in response to the command to read the recognition information, the controller 141 reads the second recognition information REC_D2 stored in the storage unit 142 to convert the information into the signal that can be interfaced and outputs the converted second recognition information REC_D2 through the interface 110.

To determine the potential level of the status check pin, the control unit 140 includes registers illustrated in FIG. 5, and stores source codes so that the control unit 140 can selectively perform DDC depending on the potential level of the status check pin, as shown in FIG. 6

For example, when the first host device 200 is connected to the interface 110 and the status check pin is in a low potential level, the control unit 140 determines the potential level of the status check pin, and the DDC_CTRL register is coded to a pre-set value 0X00 of IF conditional sentence so that DDC function can be deactivated. Accordingly, the control unit 140 prevents the second recognition information REC_D2 from being read from the storage unit 142.

In contrast, if the second host device 300 is connected to the interface 110 and the status check pin is maintained as a high potential level, the control unit 140 determines the potential level of the status check pin, and the DDC CTRL register is coded to a pre-set value 0X80 of IF conditional sentence so that DDC function can be activated. Accordingly, the control unit 140 reads the second recognition information REC_D2 from the storage unit 142.

The operations S120 and 130 are operated complementarily to each other depending on the transmission scheme of the received image information. In other words, the information on the potential level change of the status check pin is provided to both the switch 120 and the control unit 140, and if the switch 120 is activated, the control unit 140 prevents the second recognition information REC_D2 from reading from the storage unit 142.

In the opposite case, the switch 120 is deactivated and the first recognition information REC_D1 is prevented from being read from the memory 130 and the second recognition information REC_D2 is read from the storage unit 142 by the controller 141.

In response to the recognition information REC_D1 and REC_D2 output from operations S120 and S130, the operation S140 sets an image quality mode MODE_D of the display 150 based on a control signal provided from the first host device 200 or the second host device 300 and displays a certain image on the display 150 in response to the image quality mode set in each case and the received image information.

As described above, according to exemplary embodiments of the present general inventive concept, the number of used memory devices is reduced so that the display device can be miniaturized and manufacturing costs can be reduced, wherein the memory devices each store different recognition information that is output in response to the image information transmission scheme.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display device comprising:

an interface to receive image information from at least one host device according to an analog or digital transmission scheme to communicate with the host device and to output an alternate high or low control signal representing the transmission scheme of the host device connected thereto;

a memory unit to store digital extended display identification data (EDID) corresponding to the digital transmission scheme; and a control unit provided separately from the memory unit in the display device to store analog EDID corresponding to the analog transmission scheme, and if the image information is applied according to the digital transmission scheme, control the digital EDID stored in the memory unit to be output to the host device through the interface, and if the image information is applied according to the analog transmission scheme, read the analog EDID and output the read analog EDID through the interface to the host device.

2. The display device as claimed in claim 1, wherein the interface comprises a digital visual interface-integrated (DVI-I) connector.

3. The display device as claimed in claim 1, wherein the interface comprises a plurality of signal pins, and at least one of the signal pins is set as a status check pin to determine the transmission schemes.

4. The display device as claimed in claim 3, wherein the status check pin has a different potential level depending on the transmission schemes.

5. The display device as claimed in claim 4, wherein the switch unit is selectively activated depending on a potential level of the status check pin to provide a driving voltage to the memory.

6. The display device as claimed in claim 4, wherein the control unit is connected to the status check pin to provide second recognition information to the interface depending on the potential level of the status check pin.

7. The display device as claimed in claim 1, wherein the control unit further comprises a storage unit which stores the analog EDID.

8. The display device as claimed in claim 7, wherein the storage unit stores an image quality mode set in response to the image information, and the analog EDID is stored to the storage unit according to an address allocation scheme.

9. The display device as claimed in claim 7, wherein the control unit reads the analog EDID from the storage unit in response to the image information applied according to the analog transmission scheme.

10. The display device as claimed in claim 1, further comprising:

a switch unit to be selectively activated depending on a potential level of the control signal, wherein when the interface outputs a low control signal, the switch unit is turned on, the digital EDID is read from the memory unit and provided to the interface, and the control unit prevents the analog EDID stored in the control unit from being read.

11. The display device as claimed in claim 1, further comprising:

a switch unit to be selectively activated depending on a potential level of the control signal, wherein when the interface outputs a high control signal, the switch unit is turned off and the control unit reads the analog EDID and provides the analog EDID to the interface.

12. The display device as claimed in claim 1, wherein the memory unit stores only digital EDID and the control unit stores only analog EDID.

13. A method of driving a display device which receives image information from at least one host device and communicates with the host device to an image, the method comprising:

receiving the image information at an interface of the display device and the at least one host device;

determining a transmission scheme of the image information and outputting an alternate high or low control signal representing the transmission scheme of the host device connected to the display device;

reading digital extended display identification data (EDID) from a memory unit separate from a control unit which stores the digital EDO corresponding to a digital transmission scheme, providing the digital EDID to the host device if the determined transmission scheme is the digital transmission scheme, and preventing analog EDID from being read from the control unit of the display device; and reading analog EDID from the control unit which controls a driving of the display device and stores the analog EDID corresponding to an analog transmission scheme, and providing the read analog EDID to the host device if the determined transmission scheme is the analog transmission scheme.

14. The method as claimed in claim 13, wherein the image information is received through a digital visual interface-integrated (DVI-I) connector.

15. The method as claimed in claim 13, further comprising:

if the image information is transmitted according to the digital transmission scheme, providing a driving voltage to the memory to activate the memory; and if the image information is transmitted according to the analog transmission scheme, preventing the driving voltage from being provided to the memory to deactivate the memory.

16. The method as claimed in claim 15, wherein determining the transmission scheme of the image information determines a change of a potential level of a signal pin that is set as a status check pin among a plurality of signal pins included in the DVI-I connector.

17. The method as claimed in claim 16, wherein if the status check pin is not connected to the host device, the status check pin is in a high potential level, and if the status check pin is connected to the host device, the status check pin is in a low potential level.

18. The method as claimed in claim 13, wherein reading the digital EDID activates the memory to read the digital EDID, and prevents the analog EDID from being read from the control unit.

19. The method as claimed in claim 13, wherein reading the analog EDID deactivates the memory to prevent the digital EDID from being read, and reads the analog EDID that is stored in the control unit according to an address allocation scheme.

20. The method as claimed in claim 13, further comprising:

in response to the digital or analog EDID, setting an image quality mode by image information provided from the host device according to each transmission scheme, and displaying the image information as a certain image with the set image quality mode.

21. The method as claimed in claim 20, wherein the displaying the image information as the certain image stores the set image quality mode into the control unit, and displays the image information as the certain image depending on the image quality mode stored in the control unit.

22. The method as claimed in claim 13, wherein the digital EDID may only be read from the memory unit and the analog EDID may only be read from the control unit.

* * * * *